US010107482B1

(12) United States Patent
Hill

(10) Patent No.: US 10,107,482 B1
(45) Date of Patent: Oct. 23, 2018

(54) LIGHT SOCKET CONNECTOR

(71) Applicant: Paul S. Hill, Granger, IN (US)

(72) Inventor: Paul S. Hill, Granger, IN (US)

( * ) Notice: Subject to any disclaimer, the term of this patent is extended or adjusted under 35 U.S.C. 154(b) by 0 days.

(21) Appl. No.: 15/649,936

(22) Filed: Jul. 14, 2017

(51) Int. Cl.

| | |
|---|---|
| ***F21V 17/14*** | (2006.01) |
| ***H01R 13/213*** | (2006.01) |
| ***F21V 21/03*** | (2006.01) |
| *F21V 17/10* | (2006.01) |
| *F21S 8/04* | (2006.01) |

(52) U.S. Cl.
CPC ..... *F21V 17/14* (2013.01); *F21V 21/03* (2013.01); *H01R 13/213* (2013.01); *F21S 8/04* (2013.01); *F21V 17/102* (2013.01)

(58) Field of Classification Search
CPC ..... F21V 17/14; F21V 21/03; F21V 17/102; F21S 8/04; H01R 13/213
USPC ..... 362/649, 651, 655, 658, 647; 439/537, 439/334, 332, 333
See application file for complete search history.

(56) References Cited

U.S. PATENT DOCUMENTS 3,985,417 A * 10/1976 Fenton ..... H02G 3/20 439/334
4,003,618 A * 1/1977 Booty ..... H01R 25/162 439/113
7,641,517 B2 * 1/2010 Vogt ..... H01R 33/0836 362/651
7,905,626 B2 * 3/2011 Shantha ..... H01J 5/54 362/228
8,430,535 B2 * 4/2013 Watanabe ..... F21V 19/001 362/294
8,845,146 B2 * 9/2014 Blankestijn ..... F21V 17/14 362/373
9,459,002 B2 * 10/2016 Vogt ..... F21V 29/004

FOREIGN PATENT DOCUMENTS

JP 3032435 * 10/2000

* cited by examiner

*Primary Examiner* — Laura Tso
(74) *Attorney, Agent, or Firm* — Botkin & Hall, LLP

(57) ABSTRACT

A light disconnect system has a base that affixes to a ceiling of a structure, such as a house or other building. The disconnect system includes a removable center that is received by and can affix to the base. The base has at least two receivers that mate with tabs that are located on the center. The receivers have a slot portion adjacent to a ledge portion which is adjacent to a contact portion. The contact portion has an electrical contact that faces upwardly. The contact is electrically connected to the structure's wiring. The tabs on the center have electrical contacts that face downwardly. To install the center, the user inserts the center into the base and rotates until it stops. The user then allows gravity to lower the center, which puts the electrical contacts on the tabs to make electrical connection to the electrical contacts of the base.

13 Claims, 5 Drawing Sheets

FIG.2
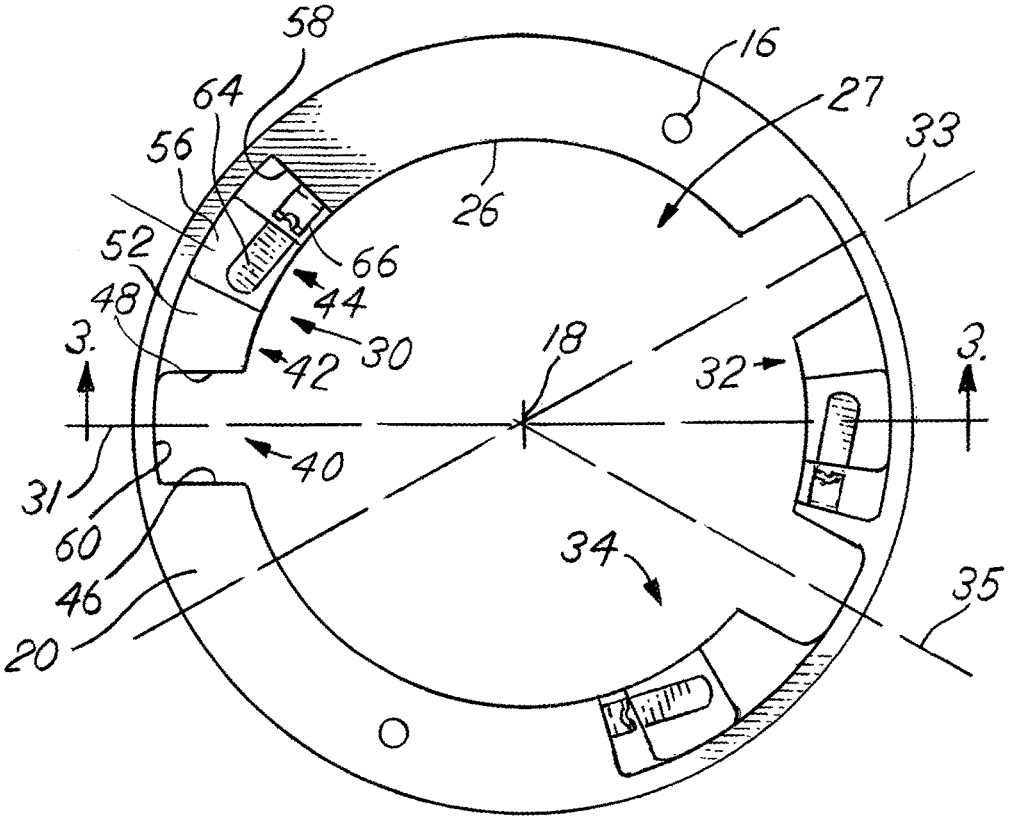
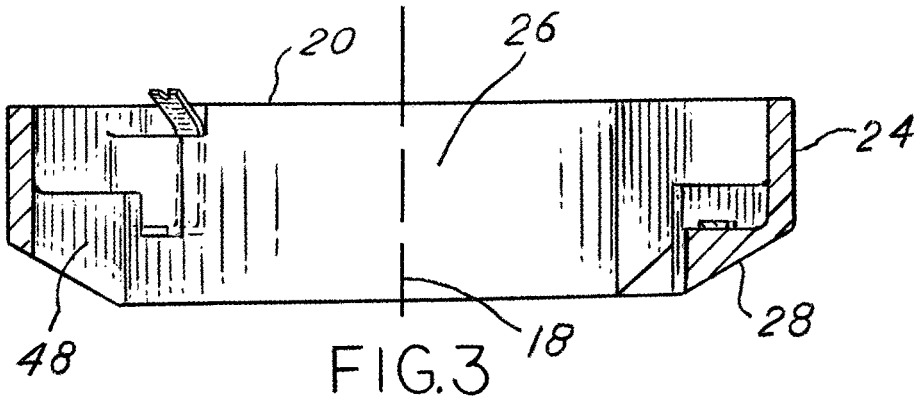
FIG.3

FIG.4
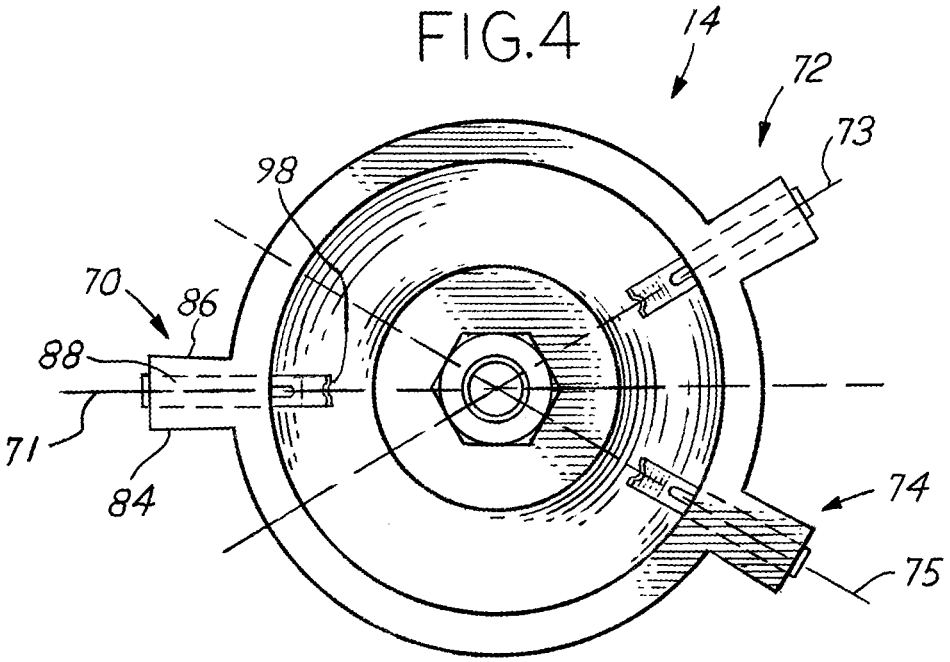
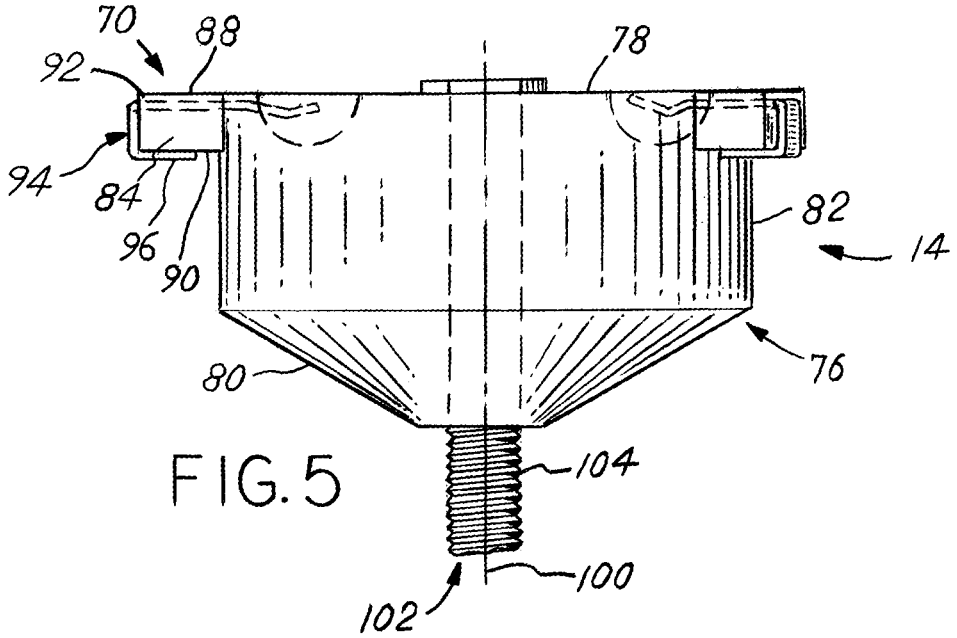
FIG.5

LIGHT SOCKET CONNECTOR

BACKGROUND OF THE INVENTION

This present disclosure relates to ceiling-mounted fixtures, particularly light fixtures that periodically need to be removed and cleaned, such as chandeliers. The typical chandelier is comprised of many glass elements or other features that periodically need to be cleaned. The task of cleaning is large and typically involves the user climbing up a ladder or using a vertical lift and removing each glass element. Removing the chandelier for cleaning is sometimes desirable but may involve physically disconnecting the wiring and unscrewing mounting screws. This is outside of the reach of the average homeowner, as electrical work for the untrained person can be dangerous. Further, the user must support the fixture while unscrewing at least two mounting screws. This is difficult and dangerous for someone standing on a ladder, where tools are difficult to use. Chandelier lowering systems exist for large fixtures located in commercial locations such as banquet halls or theaters, but those are expensive and designed to be mounted above the ceiling, where there is access from above. A low-cost simple disconnect system is needed.

SUMMARY OF THE INVENTION

The present disclosure describes a disconnect system that uses a rotary connection between a ceiling mounted base and a removable center portion. The base includes slots that mate with tabs from the removable center portion. The slots extend upwardly into a receiving cavity in the base, adjacent the slot is a ledge that is adjacent a contact area. The ledge is at a higher elevation from the contact area. The contact area has a terminal that has a wiring end that connects to the wiring in the structure and includes a contact to provide electricity to the removable center. The removable center is designed to hold and support a light fixture or other electrical device that requires power from the structure. The removable center is designed to be received by the receiving cavity and includes tabs that protrude outwardly. The tabs have a lower surface that contains a contact surface portion of a load terminal. The other end of the load terminal has a wiring connection where the electrical device can be electrically connected. The electrical contacts of the terminals make a connection when the base and center are fully mated. The system relies on gravity to make and maintain the connection between the electrical contacts in the base and the electrical contacts in the removable center. The tabs are arranged and sized so that the removable center can be installed to the base in only one configuration to prevent the user from improperly installing the removable center. Improperly installing the removable center would result in improper wiring of the electrical device.

BRIEF DESCRIPTION OF THE DRAWINGS

A preferred embodiment of this invention has been chosen wherein:

FIG. 2 is a top view of the ceiling base;

FIG. 3 is a section view 3-3 of the ceiling base in FIG. 2;

FIG. 4 is a top view of the removable center;

FIG. 5 is a side view of the removable center;

DESCRIPTION OF THE PREFERRED EMBODIMENT

Figure 1:
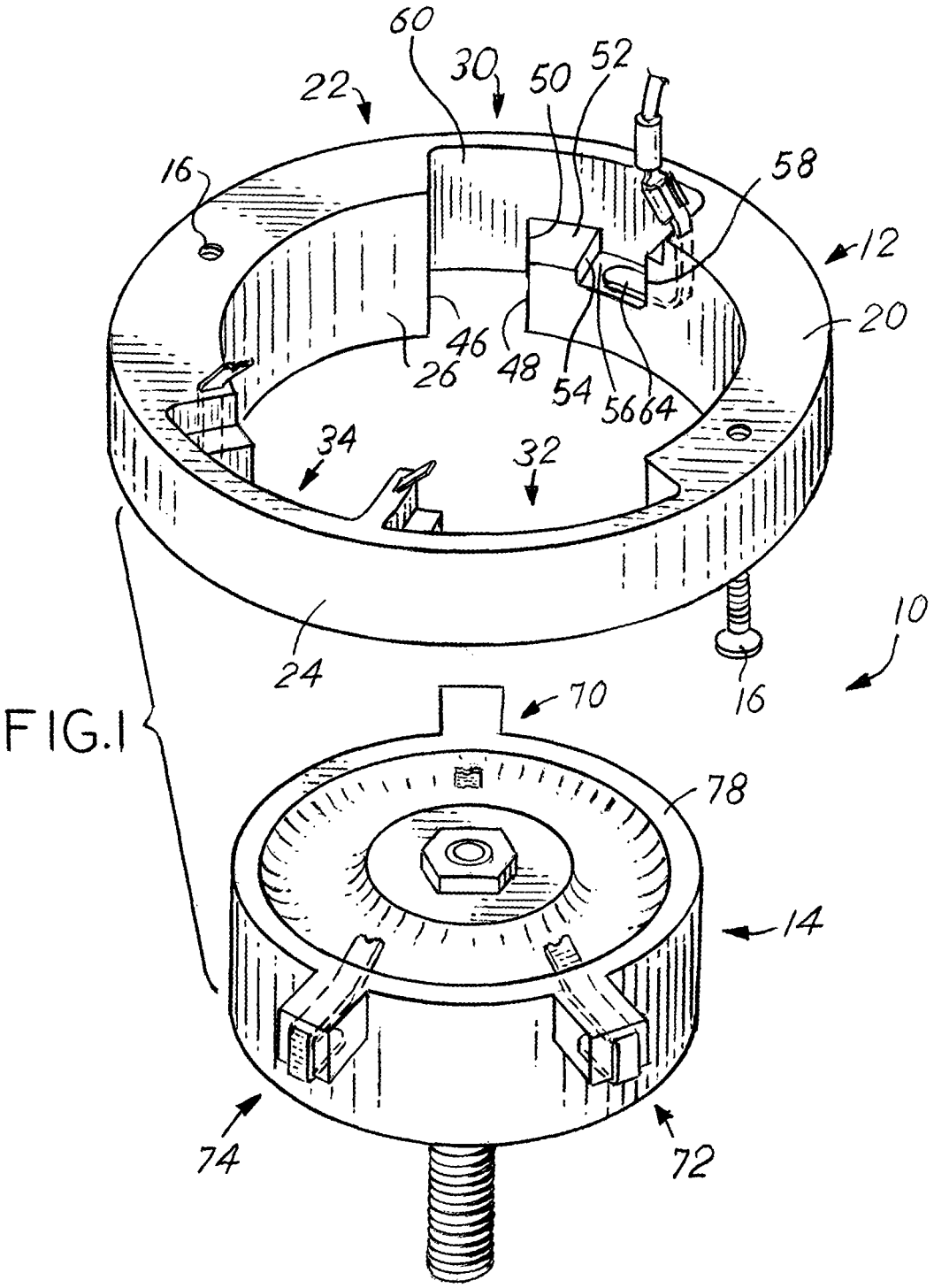
FIG. 1 is a top isometric view of the disconnect system.
Figure 6:
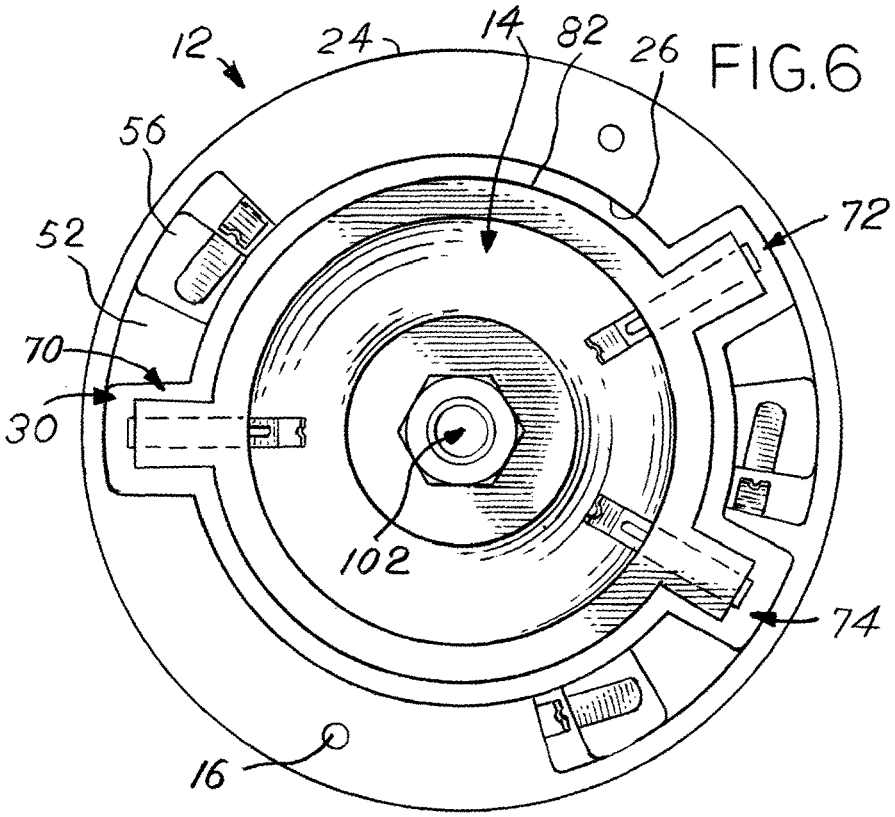
FIG. 6 is a top view of the disconnect system with the removable center and ceiling base in the first position for mating.
Figure 7:
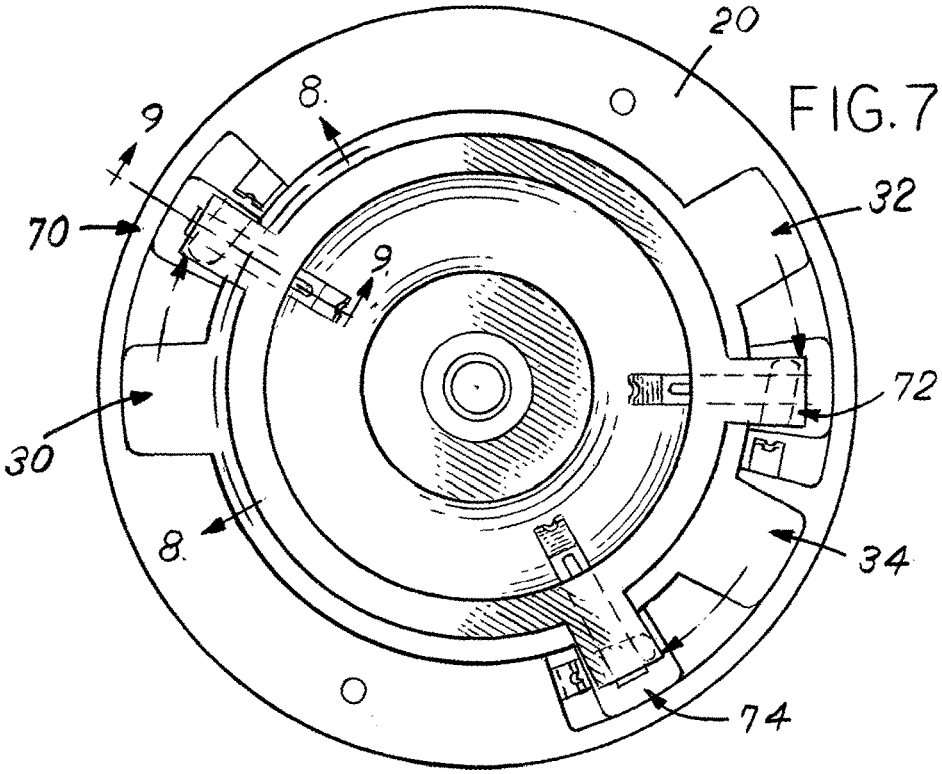
FIG. 7 is a top view of the disconnect system with the removable center and ceiling base completely mated.
Figure 8:
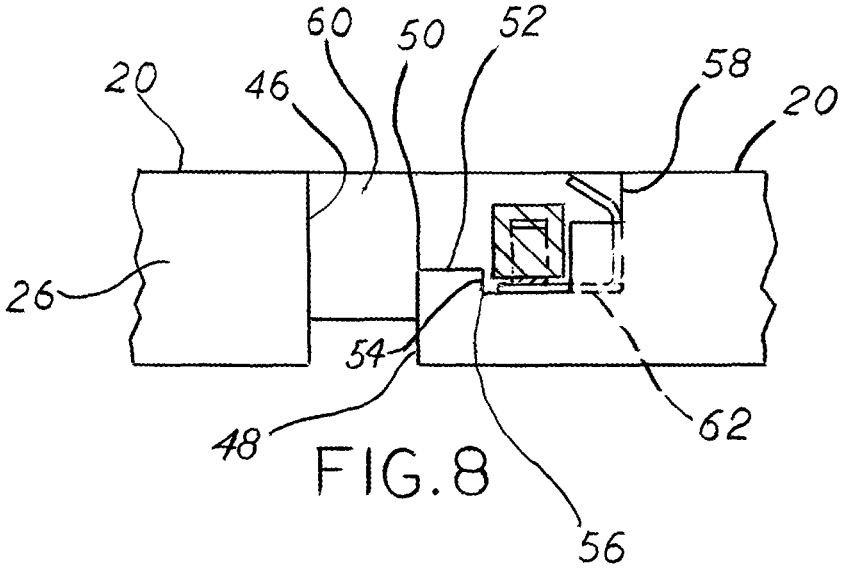
FIG. 8 is a partial section view 8-8 in FIG. 7.
Figure 9:
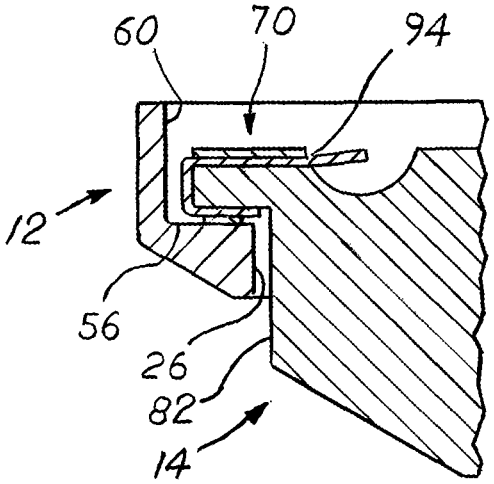
FIG. 9 is a partial section view 9-9 in FIG. 7.

An electrical disconnect system 10 is shown in FIG. 1 that has a ceiling base 12 and a removable center 14. The removable center 14 is designed to mate to the ceiling base 12 and be removed by lifting, turning, and then lowering the ceiling base 12 and whatever electrical device (not shown) is affixed thereto. The removable center 14 and ceiling base 12 are formed from a material that does not conduct electricity. The mating of the ceiling base 12 and removable center 14 is accomplished by vertical insertion of the removable center 14 into the ceiling base 12, shown in FIG. 6. The user then rotates the removable center 14 as shown in FIG. 7 to secure the two parts and make the electrical connection. The weight of the electrical device from gravity maintains the biased contact of electrical connections between the ceiling base 12 and removable center 14. The force and direction of gravity is depicted as the arrow in FIG. 9. The system 10 contains no other biasing spring or other features to maintain the electrical connection between the ceiling base 12 and removable center 14. The user knows the mating is complete and secure because the electrical connections are only made when the removable center 14 is in the position shown in FIG. 7.

The ceiling base 12 is designed to be affixed to a ceiling (not shown) using mounting fasteners 16. A mounting surface 20 is designed to contact an electrical box (not shown) when the fasteners 16 are fastened to the electrical box. Electrical boxes and fastening to the same are well-known in the art. The ceiling base 12 has a wall 22 with an outer surface 24 and an inner surface 26. Both surfaces 24, 26 are shown substantially cylindrical but can be formed from other shapes, including but not limited to a square or octagon. The ceiling base 12 has receivers 30, 32, and 34 that are located around the inner surface 26. The inner surface 26 creates a central aperture 27. As shown, the central aperture 27 is a through-hole, but it is contemplated that a top wall extends across to cover the aperture 27 that would be located near the mounting surface 20. The receivers 30, 32, 34 are shown as having identically sized features but it is contemplated that they could be located at different elevations, have different sizes, or possess other features that makes one receiver different from another receiver.

Receiver 30 is located at a first angular position around the circumference of the ceiling base 12. The receiver 30 is made up of many surfaces that form different portions: a slot portion 40, a ledge portion 42, and a contact portion 44. The slot portion 40 has boundary surfaces 46, 48 that extend through a downward facing surface 28. As shown in FIG. 1, intermediate boundary surface 48 is shorter than outer boundary surface 46. The boundary surfaces 46, 48 define the width of the slot portion 40. The intermediate boundary surface 48 terminates at a top edge 50 where it meets the top surface 52 of the ledge portion 42. The top edge 50 defines the boundary between the slot portion 40 and ledge portion 42. The top surface 52 may be sloped, curved, or ramped. The ledge surface 52 terminates where it meets an offset surface 54. The offset surface 54 defines the boundary between the ledge portion 42 and the contact portion 44. The contact portion 44 has a contact surface 56 that is lower than the ledge surface 52. The contact surface 56 has a width defined by the distance between the offset surface 54 and stop surface 58. An arcuate surface 60 extends across portions 40, 42, and 44 between boundary surface 46 and stop surface 58. The arcuate surface 60 and inner surface 26 are centered on a central axis 18. The contact portion 44 has a terminal 62 with a connection surface 64 that overlays the contact surface 56. The terminal 62 has a wiring end 66, where the user connects the ceiling base 12 to external wiring or power source. The wiring end 66 is shown as having blade connectors but it is contemplated that a screw type of terminal is used, as is common in home wiring. The terminal 62 is retained in and secured to the ceiling base 12. It is contemplated that intermediate boundary surface 48 is continuous with ledge surface 52 and the top edge 50 is either nonexistent or makes a smooth transition between the boundary surface 48 and ledge surface 52.

The second receiver 32 and third receiver 34 contain the same features as the receiver 30. As shown in FIG. 2, the second receiver 32 is at angular position 33 and the third receiver 34 is at angular position 35. The angular positions of the receivers 30, 32, 34 are different to allow the removable center 14 to be installed in the ceiling base 12 in only one orientation. It is contemplated that the width of the slot portion 40 of one of the receivers 30, 32, 34 is different than the other receivers. It is further contemplated that the ledge surface 52 between the receivers 30, 32, and 34 are at different elevations along with the adjacent contact surface 56.

The removable center 14 has tabs 70, 72, and 74 that extend radially outwardly from a body 76. The body 76 has a top surface 78, a downwardly facing surface 80, and an outer diameter 82 that extends between them. The downwardly facing surface 80 is shown as conical but other shapes and contours are possible, including but not limited to planar, spherical or another shape not described herein. The tabs 70, 72, and 74 extend outwardly from the outer diameter 82 near the top surface 78.

Tab 70 is located at a first angular position around the circumference of the outer diameter 82. Tab 70 is formed from side surfaces 84, 86 that are spaced apart to define the width of the tab. The tab 70 has a top surface 88 and an oppositely located lower surface 90. The tab 70 further includes an outer surface 92 and a terminal 94 to provide an electrical connection. The terminal 94 has a connection surface 96 and a wiring end 98 where the user connects the wiring to the light or other wired device.

As shown in the FIGS, a central axis 100 extends through the center of a central aperture 102 of a mounting rod 104. The central aperture 102 allows wiring (not shown) to pass from the terminals 62 to the light or other wired device. The mounting rod 104 is threaded and is a common method to affix fixtures or other devices and is well-known in the art. It is contemplated that instead of or in addition to the mounting rod 104, threaded holes are provided in the body 76 or downwardly facing surface 80 to affix a fixture that does not use a threaded mounting rod 104 for mounting.

The second tab 72 and third tab 74 contain the same features as tab 70. As shown in FIG. 4, the second tab 72 is at angular position 73 and the third tab 74 is at angular position 75. It is contemplated that the width of the tab, defined by the distance between side surfaces 84 and 86, is unique compared to the other tabs but complimentary to the width of the corresponding slot. In the event the ledge surfaces 52 and contact surfaces 56 are at unique elevations between the receivers 30, 32, and 34, the tabs 70, 72 and 74 would be at complimentary elevations to their corresponding slots. The elevations and/or widths of the tabs and receivers provide a unique installation position between the ceiling base 12 and removable center 14.

The arrangement of the tabs 70, 72, and 74 at their respective angular positions 71, 73, and 75 are complimentary to the angular positions 31, 33, and 35 of the receivers 30, 32, and 34. The angular positions of the tabs and receivers are unequal. Because the positions are unequal, they are uniquely complimentary. The tabs 70, 72, and 74 can be simultaneously received in the receivers 30, 32, and 34, as is shown in FIG. 6, but in only one orientation between the ceiling base 12 and removable center 14. This aligns the central axis 100 to central axis 18. The user then can axially insert the removable center 14 into the central aperture 27 with each tab 70, 72, 74 entering its corresponding receiver 30, 32, 34. This is shown in FIG. 6. Once the removable center 14 is inserted sufficiently, the lower surfaces 90 are above the ledge surfaces 52 to allow the user to rotate the removable center 14 toward the position shown in FIG. 7. The higher elevation of the ledge surfaces 52 over contact surfaces 56 in combination with the force of gravity prevent accidental rotation and removal of the removable center 14. Attempts to rotate the removable center 14 without lifting it would result in the side surfaces 84 contacting the offset surfaces 54.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A light disconnect system comprising:

a receiver base adapted to be affixed to a downwardly facing horizontal surface, said receiver base having an upper mounting surface adapted to contact said horizontal surface and an oppositely located downward facing surface, said receiver base having an outer surface extending between said upper mounting surface and said downward facing surface, said receiver base having a receiving aperture extending from said downward facing surface towards said upper mounting surface, said receiving aperture having an inner cylindrical surface centered about a central axis extending through said receiver base and perpendicular to said upper mounting surface;

said receiving aperture having a first tab receiver located at a first angular position on said inner cylindrical surface, said tab receiver having a first slot having a first width defined by first outer boundary surface and an intermediate boundary surface, said first outer and said first intermediate boundary surface extending from said inner cylindrical surface toward said outer surface, said first intermediate boundary surface terminating at a first ledge surface, said first ledge surface facing away from said downward facing surface and spaced from said upper mounting surface by a first distance, said first ledge surface terminating at a first offset surface, said first offset surface extending between said first ledge surface and a first contact surface, said first contact surface extending between said first ledge surface and a first stop surface, said first contact surface spaced from said upper mounting surface by a distance greater than said first distance, said first tab receiver having a first arcuate surface coaxial with said inner cylindrical surface and extending between said first outer boundary surface and said first stop surface, said first arcuate surface located at a greater radial distance from said central axis than said inner cylindrical surface; said first tab receiver having a first base electrical contact having a first wiring terminal portion and a first power contact portion, said first power contact portion overlaying said first contact surface, said first base electrical contact adapted to carry electrical current between said first wiring terminal portion and said first power contact portion;

a removable center adapted to be removably mated with said receiving aperture, said removable center having a body portion centered about a central axis, said body portion having an upper surface and an oppositely located light facing surface, said body portion having an outer cylindrical surface extending therebetween;

said removable center having a first tab located at a first angular position and extending radially outward from said outer cylindrical surface, said first tab terminating at a first outer surface, said first tab having a first lower surface extending between said outer cylindrical surface and said first outer surface, said first tab having a first load electrical contact having a load contact portion and a load terminal, said load contact portion overlaying said first lower surface, said first load electrical contact adapted to carry electrical current between said load terminal and said load contact portion; and when said removable center is mated with said receiver base, said first load electrical contact overlays said first base electrical contact to form an electrical connection between said first load electrical contact and said first base electrical contact, said electrical connection being held by gravity.

2. The light disconnect system of claim 1, further comprising a second tab receiver at a second angular position on said inner cylindrical surface of said receiver base, said second tab receiver having a second slot having a second width defined by second outer boundary surface and an intermediate boundary surface, said second outer and said second intermediate boundary surface extending from said inner cylindrical surface toward said outer surface, said second intermediate boundary surface terminating at a second ledge surface, said second ledge surface facing away from said downward facing surface and spaced from said upper mounting surface by a second distance, said second ledge surface terminating at a second offset surface, said second offset surface extending between said second ledge surface and a second contact surface, said second contact surface extending between said second ledge surface and a second stop surface, said second contact surface spaced from said upper mounting surface by a distance greater than said second distance, said second tab receiver having a second arcuate surface coaxial with said inner cylindrical surface and extending between said second outer boundary surface and said second stop surface, said second arcuate surface located at a greater radial distance from said central axis than said inner cylindrical surface; said second tab receiver having a second base electrical contact having a second wiring terminal portion and a second power contact portion, said second power contact portion overlaying said second contact surface, said second base electrical contact adapted to carry electrical current between said second wiring terminal portion and said second power contact portion, said removable center having a second tab located at a second angular position and extending radially outward from said outer cylindrical surface, said second tab terminating at a second outer surface, said second tab having a second lower surface extending between said outer cylindrical surface and said second outer surface, said second tab having a second load electrical contact having a load contact portion and a load terminal, said load contact portion overlaying said second lower surface, said second load electrical contact adapted to carry electrical current between said load terminal and said load contact portion when said removable center is mated with said receiver base, said second base electrical contact on said second tab receiver is electrically connected to said second load electrical contact on said removable center.

3. The light disconnect system of claim 2, wherein said second angular position is different from said first angular position.

4. The light disconnect system of claim 2, wherein said first tab has a first tab width complimentary to said first width of said first slot, said second tab has a second tab width complimentary to said second width of said second slot on said second tab receiver, said first width being different from said second width.

5. The light disconnect system of claim 2, further comprising a third tab receiver at a third angular position on said inner cylindrical surface of said receiver base, said removable center having a third tab located at a third angular position, when said removable center is mated with said receiver base, a third base electrical contact on said third tab receiver is electrically connected to a third load electrical contact on said removable center.

6. The light disconnect system of claim 5, wherein said third angular position is different from said first and said second angular positions.

7. The light disconnect system of claim 1, further comprising a central through hole located on said central axis of said removable center.

8. A light disconnect system adapted to be affixed to a ceiling, said system comprising:

a receiver base having an upper mounting surface adapted to be fixed with respect to said ceiling and having an oppositely located downward facing surface, said receiver base having a receiving aperture extending from said downward facing surface towards said upper mounting surface, said receiving aperture having an inner surface centered about a central axis extending through said receiver base and intersecting said upper mounting surface;

said receiving aperture having a first tab receiver located at a first angular position on said inner cylindrical surface, said first tab receiver having a first slot having a first width defined by a first outer boundary surface and an intermediate boundary surface, said first outer and said first intermediate boundary surface extending from said inner cylindrical surface toward said outer surface, said first intermediate boundary surface terminating at a first ledge surface, said first ledge surface facing away from said downward facing surface and spaced from said upper mounting surface by a first distance, said first ledge surface terminating at a first offset surface, said first offset surface extending between said first ledge surface and a first contact surface, said first contact surface extending between said first ledge surface and a first stop surface, said first contact surface spaced from said upper mounting surface by a distance greater than said first distance, said first tab receiver having a first arcuate surface coaxial with said inner cylindrical surface and extending between said first outer boundary surface and said first stop surface, said first arcuate surface located at a greater radial distance from said central axis than said inner cylindrical surface; said first tab receiver having a first base electrical contact having a first wiring terminal portion and a first power contact portion, said first power contact portion overlaying said first contact surface, said first base electrical contact adapted to carry electrical current between said first wiring terminal portion and said first power contact portion;

a removable center adapted to be removably mated with said receiving aperture, said removable center having a body portion centered about a central axis, said body portion having an outer cylindrical surface;

said removable center having a first tab located at a first angular position and extending radially outward from said outer cylindrical surface, said first tab terminating at a first outer surface, said first tab having a first lower surface extending between said outer cylindrical surface and said first outer surface, said first tab having a first load electrical contact having a load contact portion and a load terminal, said load contact portion overlaying said first lower surface, said first load electrical contact adapted to carry electrical current between said load terminal and said load contact portion; and when said removable center is mated with said receiver base, said first load electrical contact overlays said first base electrical contact to form an electrical connection between said first load electrical contact and said first base electrical contact, said electrical connection being made by gravity.

9. The light disconnect system of claim 8, wherein said receiving aperture having a second tab receiver located at a second angular position on said inner cylindrical surface, said second tab receiver having a second slot having a second width defined by second outer boundary surface and an intermediate boundary surface, said second outer and said second intermediate boundary surface extending from said inner cylindrical surface toward said outer surface, said second intermediate boundary surface terminating at a second ledge surface, said second ledge surface facing away from said downward facing surface and spaced from said upper mounting surface by a second distance, said second ledge surface terminating at a second offset surface, said second offset surface extending between said second ledge surface and a second contact surface, said second contact surface extending between said second ledge surface and a second stop surface, said second contact surface spaced from said upper mounting surface by a distance greater than said second distance, said second tab receiver having a second arcuate surface coaxial with said inner cylindrical surface and extending between said second outer boundary surface and said second stop surface, said second arcuate surface located at a greater radial distance from said central axis than said inner cylindrical surface; said second tab receiver having a second base electrical contact having a second wiring terminal portion and a second power contact portion, said second power contact portion overlaying said second contact surface, said second base electrical contact adapted to carry electrical current between said second wiring terminal portion and said second power contact portion, said removable center having a second tab located at a second angular position and extending radially outward from said outer cylindrical surface, said second tab terminating at a second outer surface, said second tab having a second lower surface extending between said outer cylindrical surface and said second outer surface, said second tab having a second load electrical contact having a load contact portion and a load terminal, said load contact portion overlaying said second lower surface, said second load electrical contact adapted to carry electrical current between said load terminal and said load contact portion.

10. The light disconnect system of claim 9, wherein said second angular position is different from said first angular position.

11. The light disconnect system of claim 9, further comprising a third tab receiver at a third angular position on said inner cylindrical surface of said receiver base, said removable center having a third tab located at a third angular position, when said removable center is mated with said receiver base, a third base electrical contact on said third tab receiver is electrically connected to a third load electrical contact on said removable center.

12. The light disconnect system of claim 11, wherein said third angular position is different from said first and said second angular positions.

13. The light disconnect system of claim 8, further comprising a central through hole located on said central axis of said removable center.

* * * * *